US006526666B1

(12) United States Patent
Lastinger, Jr.

(10) Patent No.: US 6,526,666 B1
(45) Date of Patent: Mar. 4, 2003

(54) ACCU-CENTER

(75) Inventor: Donald L. Lastinger, Jr., Palm Bay, FL (US)

(73) Assignee: Archer's Concept's Inc., Palm Bay, FL (US)

( * ) Notice: Subject to any disclaimer, the term of this patent is extended or adjusted under 35 U.S.C. 154(b) by 0 days.

(21) Appl. No.: 09/960,434

(22) Filed: Sep. 21, 2001

(51) Int. Cl.[7] ..... F41G 1/467; F41G 1/36
(52) U.S. Cl. ..... 33/265; 124/87; 33/DIG. 21
(58) Field of Search ..... 33/265, 286, 227, 33/263, DIG. 21; 124/87; 42/132

(56) References Cited

U.S. PATENT DOCUMENTS

| | | | | | |
|---|---|---|---|---|---|
| 3,088,212 | A | | 5/1963 | Smith | 33/180 |
| 4,689,887 | A | * | 9/1987 | Colvin | 33/265 |
| 4,911,137 | A | | 3/1990 | Troncoso | 33/506 |
| 5,379,746 | A | | 1/1995 | Sappington | 124/87 |
| 5,495,675 | A | | 3/1996 | Huang | 33/241 |
| 5,505,000 | A | * | 4/1996 | Cooke | 33/286 |
| 5,634,278 | A | * | 6/1997 | London | 124/87 |
| 5,906,054 | A | | 5/1999 | Asher | 33/265 |
| 5,983,879 | A | | 11/1999 | Gifford | 124/1 |
| 6,073,352 | A | * | 6/2000 | Zykan et al. | 33/265 |
| 6,094,829 | A | * | 8/2000 | Koestler, III | 33/265 |
| 6,134,793 | A | | 10/2000 | Sauers | 33/265 |
| 6,220,235 | B1 | | 4/2001 | Sands | 124/1 |
| 6,366,344 | B1 | * | 4/2002 | Lach | 356/3.1 |

* cited by examiner

*Primary Examiner*—Diego Gutierrez
*Assistant Examiner*—Amanda J. Hoolahan
(74) *Attorney, Agent, or Firm*—Brian S. Steinberger; Law Offices of Brian S. Steinberger, P.A.

(57) ABSTRACT

A novel archery device which defines the position of the arrow rest so that upon release of the bowstring the arrow is center-shot, i.e., it will fire straight ahead with optimum flight. The device has a visible light source arrow rest adjustment fixture which is temporarily secured to existing site mounting holes on a riser portion of a strung bow and includes an aligning component. The aligning component can move both laterally and pivotally so that a light emission from the fixture can transverse the entire length of an arrow attached to the nock point/portion of the bowstring and rest on a properly positioned arrow rest so that the arrow when fired has optimum flight. The light source can be a visible light beam, a laser light beam, and the like. The fixture is simple, lightweight, portable and accurate. The fixture can be easily removed prior to shooting the arrow.

16 Claims, 4 Drawing Sheets

Fig. 1
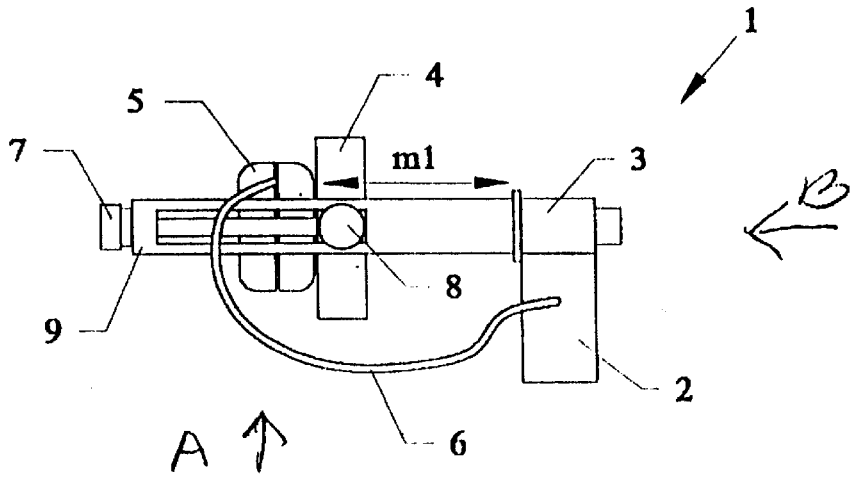
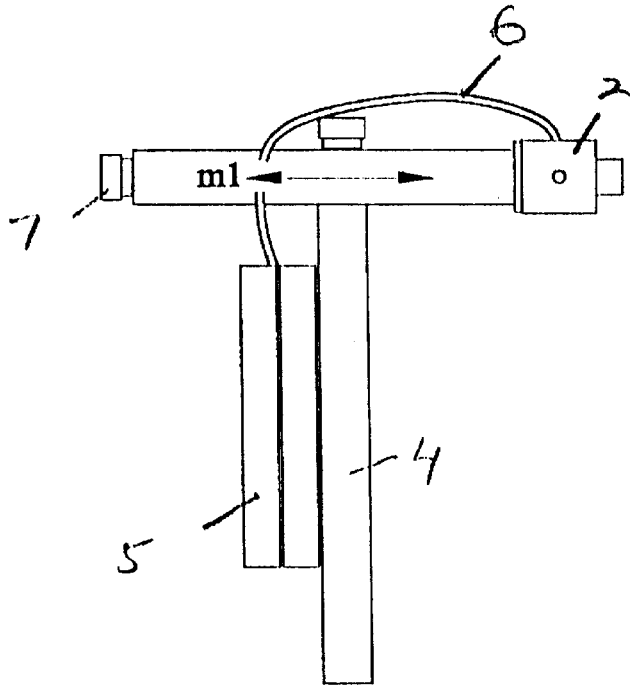
Fig. 2
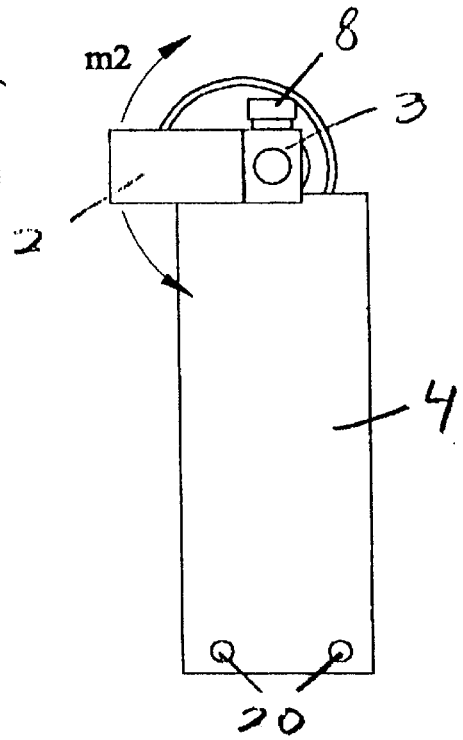
Fig. 3

ACCU-CENTER

FIELD OF THE INVENTION

This invention relates to archery bows and more particular to a device for and a method of accurately center-shot positioning of an arrow rest whereby the arrow will fire straight with improved accuracy.

BACKGROUND AND PRIOR ART

There is a need for properly centering an arrow in an archery bow so that the arrow will shoot correctly, accurately and without diverging from the original sighting line from which it was aimed and shot. This is particularly critical with respect to compound archery bows which were introduced in the late 1960's and which have undergone much structural change in the last decade and increasing popularity with archers.

One common method employed by archers to try and determine the true center-shot position of a bow is to shoot one unfletched arrow and two or more fletched arrows from the bow and observe the orientation of the shot arrows in the archery target before adjusting the in/out placement of the arrow rest and cushion plunger. Much shooting with its attendant danger and adjusting must be made before the arrows group in the target bale with about the same vertical orientation, indicating a center-shot position. Achieving and retaining a center-shot position for the bow remains a difficultly achievable property (as well as time consuming) continued to be sought by today's archer.

Another time consuming and crude method of determining the center-shot position is to dangle an arrow from the bowstring while the bow is suspended face down between two supports. The proper position of the rest and/or plunger is then guessed at, the plunger and/or rest are adjusted and the bow is retested until it is corrected to the center-shot position.

There have been numerous patent teachings to improve the accuracy required in the operation of an archery bow. For example, U.S. Pat. No. 3,088,212 to Smith describes a bow square device for checking the bracing height and locating the nocking points on the bow string comprising an elongated blade being of generally rectangular shape and having an upper straight edge and a lower straight edge, a scale in inches on said blade, a base member of generally rectangular shape being rigidly joined to one end of said blade at right angles thereto in T-shaped relation and having a string contact edge opposite said blade and at right angles to said straight edges, a notch in said contact edge spanning an area intersected by lines projected from said straight edges, a pair of spring clips spaced from one another on said base and projecting outwardly from said string contact edge, said clips forming a clamp for holding the bow string firmly against said contact edge and having a string receiving slot facing in the direction opposite said blade, and a scale in inches on said base adjacent said notch whereby said nock position of the bow string can be realized. It teaches nothing of tuning the center-shot position.

Some 27 years later, Troncoso in U.S. Pat. No. 4,911,137 described a center-shot positioning device obtained by combining an elongated L-shaped arm having a first portion adapted for alignment parallel to the sidewall in the riser section of an archery bow, and a second integral portion adapted to extend transversely of an archery bow towards the bowstring of said bow; means secured to said first portion of said arm for releasable securing said arm to said sidewall of said riser section of said archery bow; and, a means connected to said second portion of said arm for aligning the front end of an archery arrow when the rear end of said arrow is connected to said bowstring of said archery bow, so that said front end and rear end of said arrow are spaced laterally the same distance from and parallel to said rear true sidewall, for rather inadequate center-shot shooting and modestly improved accuracy and arrow flight for the bows of its time.

Other more recent patent literature directed solely to bow sights includes:

- U.S. Pat. No. 5,379,746 by Sappington where a slidingly engaged bracket containing a bow sight is secured to the bow;
- U.S. Pat. No. 5,495,675 by Huang teaches a bow sight of a swivel laser module in combination with a sighting device for night archery;
- U.S. Pat. No. 5,906,054 by Asher teaches a peep bow sight which is positioned on the weapon away from the traditional sighting line with two magnified reference displays; and,
- U.S. Pat. No. 6,134,793 by Sauers describes attaching a laser directly to an arrow for a bow sight alignment system.

Another reference which describes a large complicated mechanical bow tuning device is reported in U.S. Pat. No. 5,983,879 by Gifford who first levels his bow and thereafter tunes his archery device by attaching his arrow to the bow and an arrow stabilizer.

In a much more complicated manner than that taught by Smith (earlier referenced with regard to nock positioning), Sands in U.S. Pat. No. 6,220,235 B1 discloses a nock travel indicator which utilizes a pen attached to the bow string whereby the draw of archery bow can be calibrated.

There still remains a need for a simple, efficient, compact archery device which provides an archery arrow rest to be correctly aligned with respect to the bowstring so that upon release of the bowstring, the arrow will fire straight ahead with improved accuracy.

SUMMARY OF THE INVENTION

A primary objective of the invention is to develop a simple compact apparatus for temporary mounting on a bow to provide center-shot tuning of the arrow rest in reference to the bow string.

A secondary object of the invention is to provide a simple archery device for aligning of the arrow rest in reference to the bow string.

A third object of the invention is to provide a simple archery device with an improved arrow flight to a target.

A fourth object of the invention is to provide a process for efficient center-shot tuning of a composite archery device whereby its arrow flight is improved.

A fifth object of the invention is to provide a system for providing an optimum arrow rest position by moving an arrow rest so that a visible light source can transverse a substantial length of an arrow shaft that is connected to the nock portion of a bow string.

A preferred embodiment of the invention is a laser rest adjustment fixture hereafter also known as an accu-center fixture that includes a bow mounting plate for said fixture adapted for securing it temporarily to a bow riser, a pivotable light source such as a laser which enables one to laser emission transverse the entire length of the arrow which is attached to the nock of the bow string and positioned on the arrow rest; pivotal means to adjust the arrow rest position in the vertical plane with respect to the bow string; and means for releasing said arrow rest from said pivotal means after it has been positioned whereby said arrow can be laser emission transversed its entire upper surface without deviation there from.

Further objects and advantages of this invention will be apparent from the following detailed description of a presently preferred embodiment, which is illustrated in the accompanying drawings.

BRIEF DESCRIPTION OF THE FIGURES

FIG. 1 is a front end view of the laser arrow rest adjustment fixture describing the mechanism in which the laser head moves throughout its horizontal adjustment to align with the bow string.

FIG. 2 is a front view of the laser arrow rest adjustment fixture of FIG. 1 along arrow A, which shows the movement of the lateral slide of the laser head to align with the bow string.

FIG. 3 is a side view of the laser arrow rest adjustment fixture of FIG. 1 along arrow B that demonstrates the rotating motion of the laser head as it follows the length of the arrow shaft.

DESCRIPTION OF THE PREFERRED EMBODIMENT

Figure 4:
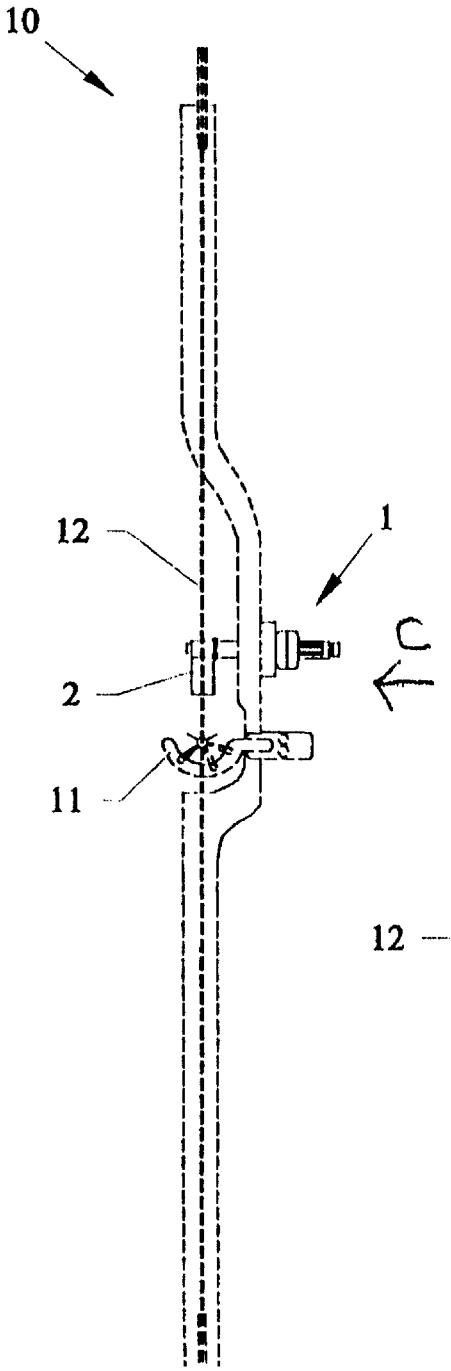
FIG. 4 is a back view of a bow with the laser arrow rest adjustment fixture attached to the sight bracket of said bow and the laser head centered with the bow string.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

To facilitate a full understanding of the technical scope of this invention the following terms are defined hereafter:

- center-shot—the horizontal positioning of the arrow in reference to the bow string and vertical adjustment of the arrow rest;
- arrow rest—the device attached to the riser of the bow which supports the frontal weight of the arrow and guides the arrow as it leaves the bow during the shooting sequence; nock—slotted rear end of an arrow;
- nock position—the location segment where the arrow is attached to the bow string that determines the vertical alignment of the arrow;
- bow tuning—the combination of center-shot and nock positions to provide optimum arrow flight; and,
- optimum arrow flight—arrow travel free of erratic movement including fish tailing and/or porpoising.

According to this invention the above objects detailed in the summary of the invention can be achieved by a uniquely simple technique of first temporarily mounting a laser arrow rest adjustment fixture to the sight mounting of the bow riser and secondly using said fixture to center-shot position the extant arrow in the arrow rest so that it is fully aligned with the bow string.

The advantages and features of the present invention will be apparent upon consideration of the following description.

Reference should now be made to FIGS. 1 to 4 which illustrate the inventive concept by providing two front, one side and one rear view, respectively, of the arrow rest adjustment fixture of the invention. Its temporary mounting on the bow makes possible the optimum arrow flight of those arrows fired from simple bows by alignment of the arrow with the bow string.

As shown in FIGS. 1–4, the arrow rest adjustment fixture 1 is used to correctly position the arrow rest so that the arrow attached to the nock of the bow string and resting on the arrow rest is aligned with the bow string, which is shown and described later in reference to FIGS. 5–7*a*. As shown initially in FIG. 1, the device (fixture) 1 consists of: a pivoting light source 2 such as a laser head secured by the laser mount 3; a bow mounting plate 4 with bracket mounting holes 20; a battery 5 which is connected by the power wire 6 to the laser in the laser head 2; the laser head adjustment screw 7; the laser head adjustment lock screw 8; and, the laser head slide 9. A motion descriptor m1 shows the manner in which the laser head 2 slides throughout its horizontal adjustment to align the arrow shaft with the bow string when used in the method of the invention.

Although the preferred light source is a laser beam as described above, any temporarily mounted light beam housed in the head 2 with a switch to turn a light beam on and off as needed can be used to transverse the arrow shaft to achieve string alignment with the fixture of the invention.

A preferred laser light source for the invention can be a laser module such as the red, green and industrial laser modules manufactured by Creative Technology Lasers of Concord, Calif., which use a visible laser light source of up to approximately 670 nm. The light source used in the invention is intended to create a visible light marking that can be seen by the user along the length of the arrow. The light source can have a beam diameter that is up to the diameter dimension of the arrow itself. Other types of lasers that emit visible beams can include LEDs (light emitting diodes), focused laser pointers, and the like. Additionally, non-laser light sources can also be used as long as the beam can be made visible along the arrow itself and meet the objectives of the subject invention.

As earlier recited, FIG. 2 is a front view of the laser arrow rest adjustment fixture which describes the movement m1 of the lateral slide of the laser head to align with the bow string and FIG. 3 is a side view of the laser arrow rest adjustment fixture that demonstrates the rotating motion m2 of the laser head as it follows the length of the arrow shaft (the numbering is common with that of FIG. 1).

As earlier recited, FIG. 4 is a back view of a bow 10 with an adjustable arrow rest 11 and the laser arrow rest adjustment fixture 1 with its pivoting laser head 2 attached to the riser of said bow to facilitate the eventual alignment of the arrow in the rest 11 with the bow string 12.

Before considering the rest of the Figures, it would be best to discuss the method of using the laser arrow rest adjustment fixture to align the arrow to be fired at rest 11 with the bow string 12.

Initially, referring to FIGS. 3, 5, 6, and 6*a*, user will attach the bow mounting plate 4 of the fixture 1 to a flat sided riser portion 110 on a bow 10 by using removable fasteners 125 such as screws and nuts, that pass through the plate mounting holes 20 and into through-holes 120 on the riser portion 110. Generally, most riser portions 110 on bows 10 have existing through-holes 120 for allowing a site to be attached to the bow 10.

The first step after the fixture 1 has been attached to the riser 110 of the strung bow 10 and an arrow end slot portion (nock) 30 is positioned about an existing nocking point 130 on a bow string 12, is to turn on the laser in the head 2 and rotate it toward the bow string 12 while adjusting the horizontal slide 9 in the direction of arrow m1 until the laser beam 15A is centered on the string 12 at the nocking point 130. When the beam 15A is able to strike the nocking point 130, the laser head adjustment locking screw is rotated to a locked position fixing the position of the laser head 2 relative to the mounting plate 4.

The second step with the arrow shaft 13 connected to the bow string 12 at the nock point of the bow string 130 and positioned in the rest 11, the laser head rotation adjustment screw 7 is unlocked by rotating counter-clockwise allowing the laser head 2 to be able to be rotated downward in the direction of arrow m2 toward the arrow shaft 13 simultaneously as the rest 11 is horizontally moved in the direction of arrow m3, until the laser dot 14 is centered on and substantially along the upper surface of the arrow shaft 13.

The final step is to rotate the laser head so that the laser dot transverses substantially the entire length of the arrow shaft 13. If the position of the rest 11 is adjusted properly, the laser dot should follow the full length of the arrow shaft 13. If it does not then a further adjustment of the rest 11 is required in order to align the arrow shaft 13 with the bow string 12.

Prior to shooting the arrow 13, the user can remove the fixture 1 by removing the removable fasteners 125, and taking off the fixture 1.

Figure 5:
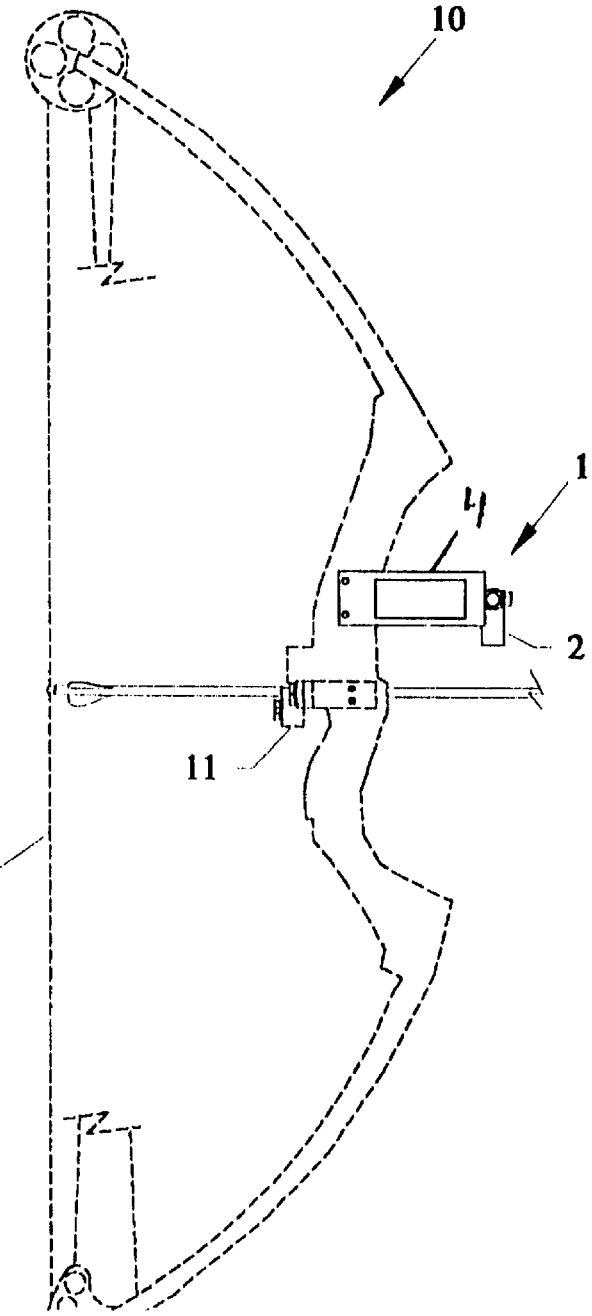
FIG. 5 is a side view of a bow of FIG. 4 along arrow C, with a mounted laser arrow rest adjustment fixture with the laser head pointing downward at the arrow shaft.

Now with reference to FIG. 5, it shows a side view of a bow 10 and string 12 with a mounted laser arrow rest adjustment fixture 1 and its pivoting laser head 2 positioned above the adjustable arrow rest 11 with its arrow shaft 13 which connected at its slotted end to the nock of the string 12.

Figures 6, 6A:
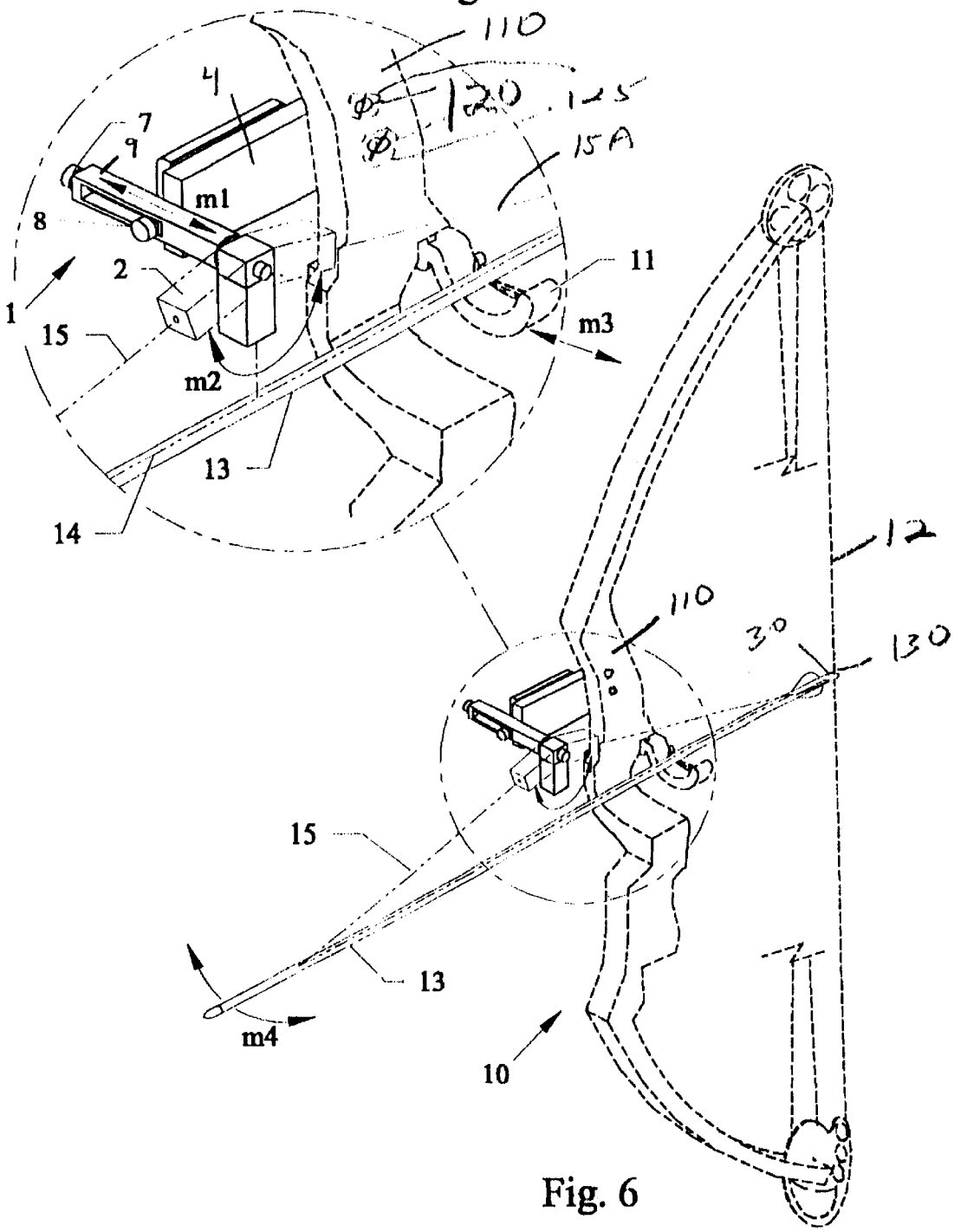
FIG. 6 is a front perspective view of a bow with a mounted laser arrow rest adjustment fixture and the pivotal laser head describing a laser path on the crown of the arrow shaft.
FIG. 6*a* is a detailed blow-up view of FIG. 6.
Figure 7:
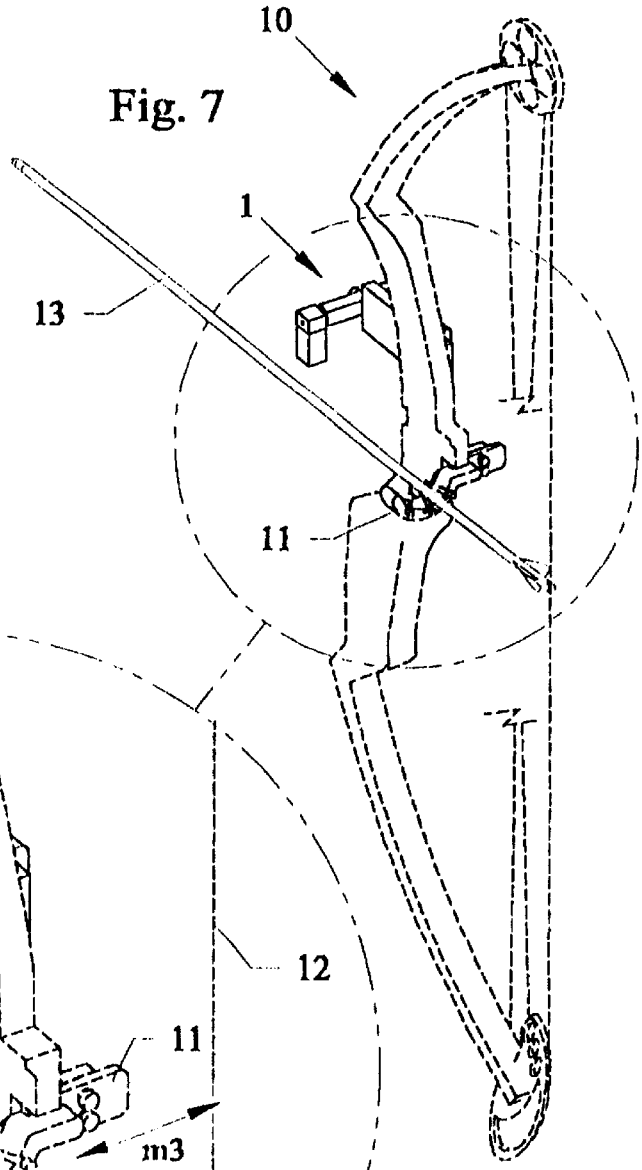
FIG. 7 is a rear perspective view of a bow with a mounted laser arrow rest adjustment fixture and the pivotal laser head describing a laser path on the crown of the arrow shaft.
Figure 7A:
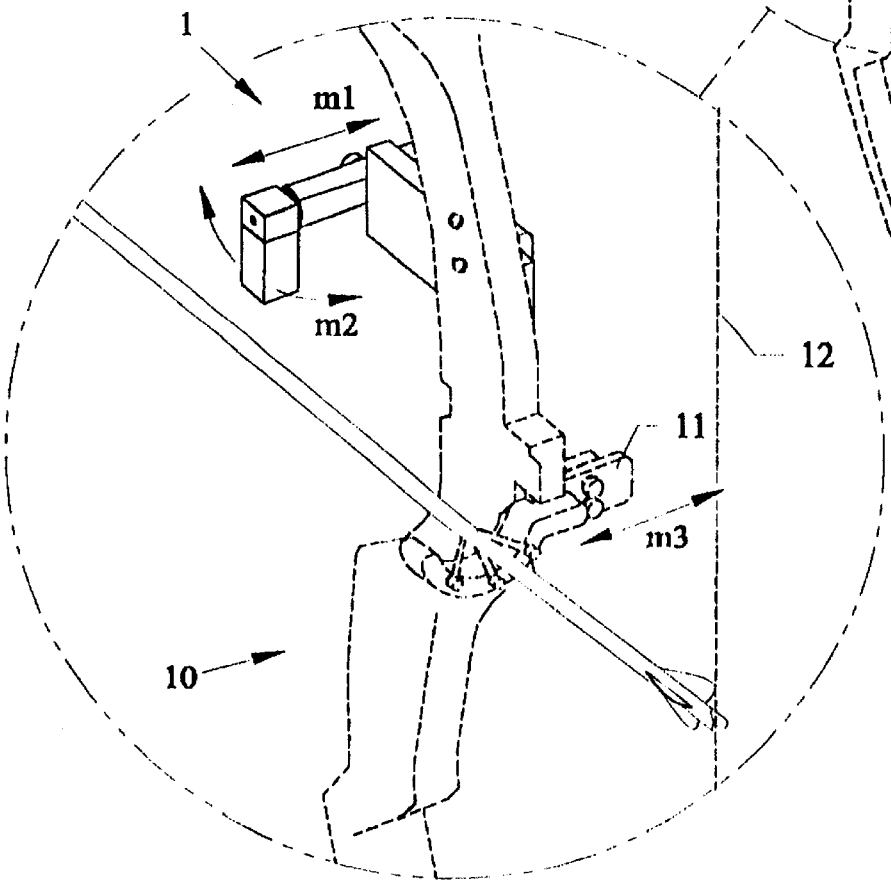
FIG. 7*a* is a detailed blow-up view of FIG. 7.

Please refer now to FIGS. 6 and 6*a* where the latter is a detailed blow-up view of the former which is a front perspective view of a bow 10 with a mounted laser arrow rest adjustment fixture 1 and pivoting laser head 2 providing a laser beam 15 which is shown as a laser path 14 on the crown of the arrow shaft 13. As earlier described in FIG. 2, m1 indicates the lateral movement of the head 2 by means of the laser head adjustment screw 7 until it is properly positioned at which point it is secured by the lock screw 8. As earlier described in FIG. 3, m2 indicates the pivotal movement of the head 2 by means of which the laser dot can put on the path 14 along the arrow shaft 13. m3 indicates the adjusting movement of the arrow rest 11 perpendicular to the arrow shaft 13 which results in the movement m4 since the slotted end of the arrow shaft 13 is attached to the nocking point of the bow string 12.

Refer now to Examples 7 and 7*a*, where again the latter is a detailed blow-up view of the former which is a rear perspective view of a bow 10 with a mounted laser arrow rest adjustment fixture 1 and pivoting laser head 2 describing laser path 14 on the crown of the arrow shaft 13. These Figures show the lateral movement m1 and pivotal movement m2 of laser head 2 as well as the lateral movement m3 of the rest 11 whereby the arrow shaft 13 is aligned with the bow string 12.

For the subject invention, the following are advantages of the laser arrow rest adjustment fixture of the invention: Increased accuracy; Simplicity of operation; Compactness of structure; and, only two moving parts for determination of the center-shot of the bow.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An arrow alignment system for archery bows, comprising in combination:

a) an arrow alignment fixture containing a movable light source;

b) a strung bow having an adjustable arrow rest;

c) an arrow having an arrow shaft; and d) means for mounting the alignment fixture to a portion of the strung bow, whereby said movable light source is positioned to provide a light beam that is moveable to transverse an entire length of the arrow shaft after the arrow shaft is adjusted to a selected position.

2. The arrow alignment system of claim 1, wherein the arrow alignment fixture includes:

means for both pivotally and laterally moving the light source.

3. The arrow alignment system of claim 1, wherein the light source includes: a laser light source.

4. The arrow alignment system of claim 1, wherein the mounting means includes:

a removable bracket having a removable fastener that attaches the alignment fixture to the portion of the strung bow.

5. The arrow alignment system of claim 1, wherein the portion of the strung bow includes: a riser portion on the strung bow.

6. An accurate-centering fixture for aligning arrows on archery bows, comprising in combination:

a) a bow with string, the bow having an adjustable arrow rest;

b) an arrow having a rear end against a nock portion of the bow string;

c) a mounting member having a light source which emits a visible light beam, the member attached to a portion of the bow;

d) means for moving the light beam to strike against the nock portion of the bow string; and e) means for adjusting the arrow rest to arrow for the moving light beam to traverse a substantial length of the arrow without deviation therefrom.

7. The accurate-centering fixture of claim 6, wherein the mounting member includes:

a bracket having fasteners which mateably fasten to a riser portion on the strung bow.

8. The accurate-centering fixture of claim 6, wherein the light source includes:

a laser light source.

9. The accurate-centering fixture of claim 6, wherein the means for moving the light source include: means for moving the light source both pivotally and laterally.

10. A method for providing arrow center-shot tuning to a strung bow with a nock portion on the bow string, and an adjustable arrow rest, comprising the steps of:

a) mounting an arrow rest alignment tool having a moveable light beam to a portion of said bow;

b) attaching an end of an arrow shaft against the nock portion of the bow string; and c) selecting a position for the adjustable arrow rest so that the moveable light beam transverses a substantial length of the arrow shaft.

11. The method of claim 10, wherein the mounting means includes the step of:

mounting the alignment tool to a riser portion on the bow with a removable fastener.

12. The method of claim 10, wherein the moveable light beam includes the step of:

emitting a visible laser beam from a laser source.

13. The method of claim 10, further including the step of:

horizontally aligning the light beam to strike against the nock portion of the bow.

14. The method of claim 13, further including the step of:

pivotally moving the light beam so that the light beam tranverses the substantial length of the arrow shaft.

15. The method of claim 10, further including the step of:

pivotally moving the light beam so that the light beam tranverses the substantial length of the arrow shaft.

16. The method of claim 10, further comprising the step of:

removing the alignment tool from the bow string prior to shooting the arrow.

* * * * *